US009649573B2

(12) United States Patent
Phamdo

(10) Patent No.: US 9,649,573 B2
(45) Date of Patent: May 16, 2017

(54) BOKAH BLOCKS

(71) Applicant: Dangvinh Phamdo, Seal Beach, CA (US)

(72) Inventor: Dangvinh Phamdo, Seal Beach, CA (US)

( * ) Notice: Subject to any disclaimer, the term of this patent is extended or adjusted under 35 U.S.C. 154(b) by 0 days.

(21) Appl. No.: 14/834,235

(22) Filed: Aug. 24, 2015

(65) Prior Publication Data

US 2016/0089615 A1 Mar. 31, 2016

Related U.S. Application Data

(60) Provisional application No. 62/056,723, filed on Sep. 29, 2014.

(51) Int. Cl.
*A63H 33/10* (2006.01)

(52) U.S. Cl.
CPC ..... *A63H 33/103* (2013.01)

(58) Field of Classification Search
CPC . A63H 3/16; A63H 3/46; A63H 33/04; A63H 33/062; A63H 33/101; A63H 33/105; E04B 1/04; E04B 1/06; E04B 1/08; E04B 1/12; E04B 1/22; Y19T 403/45; Y19T 403/54; Y19T 403/55; Y19T 403/553; Y10T 24/314; Y10T 24/316; A44C 1/00; A45D 8/36
See application file for complete search history.

(56) References Cited

U.S. PATENT DOCUMENTS 957,666 A * 5/1910 Ferguson ..... A63H 3/46 446/380
1,555,661 A * 9/1925 Grove ..... A63H 3/46 446/380
1,746,839 A * 2/1930 Main ..... A63H 3/16 446/100
1,868,049 A * 7/1932 Deichmann ..... A63H 3/46 446/100
2,063,895 A * 12/1936 Mack ..... A63H 33/102 403/329
2,662,335 A * 12/1953 Calverley ..... A63H 3/16 446/120
2,752,726 A * 7/1956 Calverley ..... A63H 3/16 403/142
2,978,020 A * 4/1961 Paulsrude ..... E05D 1/02 16/225
3,228,137 A * 1/1966 Runser ..... A63H 33/06 446/111
3,479,763 A * 11/1969 Fischer ..... A63H 33/065 446/120
3,745,694 A * 7/1973 Vennola ..... A63H 33/00 446/102

(Continued)

*Primary Examiner* — Aarti B Berdichevsky
*Assistant Examiner* — Urszula M Cegielnik

(57) ABSTRACT

A Toy assembly includes a flexible joint element and a construction member. The flexible joint element comprises two spherical components and a flexible string. The two spherical components are coupled to the flexible string at the two ends of the flexible string. The construction member comprises two slots and two holes which can receive the flexible joint element. Multiple construction members can be assembled, utilizing flexible joint elements, to construct toys or other structures with members having six (6) degrees of freedom.

19 Claims, 6 Drawing Sheets

(56) References Cited

U.S. PATENT DOCUMENTS 3,747,261 A * 7/1973 Salem ..... A63H 33/108 273/155
3,975,858 A * 8/1976 Much ..... A63H 33/102 446/107
3,987,579 A * 10/1976 Palenik, III ..... A63H 33/108 446/118
4,037,978 A * 7/1977 Connelly ..... F16B 7/04 403/164
4,067,475 A * 1/1978 Pinkau ..... B65D 81/361 206/504
4,103,451 A * 8/1978 Kawada ..... A63H 3/16 446/121
4,182,072 A * 1/1980 Much ..... A63H 33/065 220/4.24
4,408,430 A * 10/1983 Wangler ..... E04B 1/344 16/DIG. 13
4,438,605 A * 3/1984 DeLucia ..... E04B 1/76 16/225
4,699,602 A * 10/1987 Giorgi ..... A63F 9/12 273/157 R
4,997,375 A * 3/1991 Heinz ..... A63F 9/088 434/403
5,302,148 A * 4/1994 Heinz ..... A63F 9/088 273/153 S
5,800,239 A * 9/1998 Cohen ..... A63H 33/105 446/118
6,109,999 A * 8/2000 Kuo ..... A63B 19/00 446/236
6,482,063 B1 * 11/2002 Frigard ..... A63H 3/16 446/119
6,510,589 B2 * 1/2003 Schrage ..... E05D 3/12 16/225
6,669,526 B2 * 12/2003 Manville ..... A63H 33/101 446/100
2004/0128935 A1 * 7/2004 Sorensen ..... A63H 33/062 52/578
2007/0178799 A1 * 8/2007 Rudell ..... A63H 33/101 446/120

* cited by examiner

BOKAH BLOCKS

CROSS REFERENCE TO RELATED APPLICATIONS

The present patent application is a formalization of a previously filed provisional patent application entitled "BOKAH BLOCKS" filed Sep. 29, 2014, as U.S. patent application Ser. No. 62/056,723 by the inventor(s) named in this application. This patent application claims the benefit of the filing date of the cited provisional patent application according to the statutes and rules governing provisional patent applications, particularly 35 USC §119 and 37 CFR §1.78. The specification and drawings of the cited provisional patent application are specifically incorporated herein by reference.

COPYRIGHT

A portion of the disclosure of this patent document contains material which is subject to copyright protection. The owner has no objection to the facsimile reproduction by anyone of the patent disclosure, as it appears in the Patent and Trademark Office files or records, but otherwise reserves all copyright rights whatsoever.

FIELD OF INVENTION

This invention is related to a toy assembly comprising a flexible joint element and a construction member. The flexible joint element includes a flexible string and two spherical components. The construction member includes slots and circular holes which are used to receive the flexible joint element. Multiple flexible joint elements and construction members are assembled to construct toys or other structures with members having six (6) degrees of freedom.

BACKGROUND

Construction toys, such as Lego construction toys, are interlocking plastic bricks which are coupled together to construct objects such as vehicles and buildings. Construction toys are popular because they can easily be assembled and disassembled to construct a variety of objects as desired. They are also versatile for design purposes and inexpensive to use.

The present invention includes a flexible joint element and a construction member as the building block for constructing complex objects. The flexible joint element includes a flexible string and two spherical components. The construction member has six (6) faces which include apertures for receiving the flexible joint element. The apertures are cut into the faces of the construction member. In particular, four (4) slots and two (2) holes are cut into a cuboid construction member which receives a flexible joint element. A plurality of flexible joint element and construction member assemblies can be assembled to arrive at complex shapes.

SUMMARY

In one aspect, a toy assembly is disclosed wherein the assembly comprises a flexible joint element, comprising a cylindrical flexible string having a flexible-string diameter, a first flexible-string-end and a second flexible-string-end, a first spherical component having a first-spherical-component diameter, a first-spherical-component center, and a first-spherical-component thru-hole through the first-spherical-component center, and a second spherical component having a second-spherical-component diameter, a second-spherical-component center, and a second-spherical-component thru-hole through the second-spherical-component center, wherein the first spherical component receives the flexible string through the first-spherical-component thru-hole and the first spherical component is coupled with the flexible string at the first flexible-string-end and wherein the second spherical component receives the flexible string through the second-spherical-component thru-hole and the second spherical component is coupled with the flexible string at the second flexible-string-end, thereby defining a flexible-joint-element length extending between the first-spherical-component center and the second-spherical-component center, and a first cuboid construction member, defined in a first three dimensional orthogonal coordinate system having orthogonal x axis, y axis, and z axis, said first cuboid construction member having a first face and a second face a first-member length apart along the x axis, a third face and a fourth face a first-member width apart along the y axis, and a fifth face and a sixth face a first-member height apart along the z axis, wherein the origin of the first three dimensional orthogonal coordinate system is at the first face center, said first cuboid construction member comprises a first rectangular blind slot, through the first face and across the first-member width toward the positive x direction having a first depth along the x axis and a first width along the z axis, a second rectangular blind slot, through the first face and across the first-member height toward the positive x direction having a second depth along the x axis and a second width along the y axis, a third rectangular blind slot, through the second face and across the first-member width toward the negative x direction having a third depth along the x axis and a third width along the z axis, a fourth rectangular blind slot, through the second face and across the first-member height toward the negative x direction having a fourth depth along the x axis and a fourth width along the y axis, a first circular thru-hole, through the fifth face and the sixth face, along the z axis having a first-circular-thru-hole center at a first-circular-thru-hole distance from an edge of the first face and a first-circular-thru-hole diameter, and a second circular thru-hole, through the fifth face and the sixth face, along the z axis having a second-circular-thru-hole center at a second-circular-thru-hole distance from an edge of the second face and a second-circular-thru-hole diameter, wherein the first cuboid construction member receives one of the first spherical component and the second spherical component of the flexible joint element via one of the first circular thru-hole and the second circular thru-hole of the first cuboid construction member.

Preferably, the first-spherical-component diameter is equal to the second-spherical-component diameter.

Preferably, the first-spherical-component thru-hole is circular having a first-spherical-component-thru-hole diameter, wherein the second-spherical-component thru-hole is circular having a second-spherical-component-thru-hole diameter, wherein the first-spherical-component-thru-hole diameter is equal to the second-spherical-component-thru-hole diameter, and wherein the flexible-string diameter is less than or equal to the first-spherical-component-thru-hole diameter.

Preferably, the first spherical component is coupled with the flexible string at the first flexible-string-end by tying a first knot at the first flexible-string-end and the second spherical component is coupled with the flexible string at the second flexible-string-end by tying a second knot at the second flexible-string-end.

Preferably, the second rectangular blind slot, through the first face, is along a z-z axis, said z-z-axis is at a first angle from the z axis.

Preferably, the first-member width is equal to the first-member height.

Preferably, the first width is equal to the second width.

Preferably, the first depth is equal to the second depth.

Preferably, the first-circular-thru-hole distance is equal to the second-circular-thru-hole distance.

Preferably, the first-circular-thru-hole diameter is equal to the second-circular-thru-hole diameter.

Preferably, the first width, the second width, the third width, and the fourth width are equal, wherein the first depth, the second depth, the third depth, and the fourth depth are equal, wherein the first-circular-thru-hole distance and the second-circular-thru-hole distance are equal, and wherein the first-circular-thru-hole diameter and the second-circular-thru-hole diameter are equal.

Preferably, the first cuboid construction member further comprises, a third circular thru-hole, through the third face and the fourth face, along the y axis having a third-circular-thru-hole center at a third-circular-thru-hole distance from the edge of the first face and a third-circular-thru-hole diameter, and a fourth circular thru-hole, through the third face and the fourth face, along the y axis having a fourth-circular-thru-hole center at a fourth-circular-thru-hole distance from the edge of the second face and a fourth-circular-thru-hole diameter, wherein the first cuboid construction member receives one of the first spherical component and the second spherical component of the flexible joint element via one of the first circular thru-hole, the second circular thru-hole, the third circular thru-hole, and the fourth circular thru-hole of the first cuboid construction member.

Preferably, the assembly further comprises a second cuboid construction member, defined in a second three dimensional orthogonal coordinate system having orthogonal u axis, v axis, and w axis, said second cuboid construction member having a seventh face and a eighth face a second-member length apart along the u axis, a ninth face and a tenth face a second-member width apart along the v axis, and a eleventh face and a twelfth face a second-member height apart along the w axis, wherein the origin of the second three dimensional orthogonal coordinate system is at the seventh face center, said second cuboid construction member comprises a fifth rectangular blind slot, through the seventh face and across the second-member width toward the positive u direction having a fifth depth along the u axis and a fifth width along the w axis, a sixth rectangular blind slot, through the seventh face and across the second-member height toward the positive u direction having a sixth depth along the u axis and a sixth width along the v axis, a seventh rectangular blind slot, through the eighth face and across the second-member width toward the negative u direction having a seventh depth along the u axis and a seventh width along the w axis, an eighth rectangular blind slot, through the eighth face and across the second-member height toward the negative u direction having an eighth depth along the u axis and an eighth width along the v axis, a third circular thru-hole, through the eleventh face and the twelfth face, along the w axis having a third-circular-thru-hole center at a third-circular-thru-hole distance from an edge of the seventh face and a third-circular-thru-hole diameter, and a fourth circular thru-hole, through the eleventh face and the twelfth face, along the w axis having a fourth-circular-thru-hole center at a fourth-circular-thru-hole distance from an edge of the eighth face and a fourth-circular-thru-hole diameter, wherein the second cuboid construction member receives the other one of the first spherical component and the second spherical component of the flexible joint element via one of the third circular thru-hole and the fourth circular thru-hole of the second cuboid construction member.

Preferably, the second-member length is one of one half and one quarter of the first-member length.

Preferably, the first-member width, the first-member height, the second-member width, and the second-member height are equal.

Preferably, the first width, the second width, the third width, the fourth width, the fifth width, the sixth width, the seventh width, and the eighth width are equal, wherein the first depth, the second depth, the third depth, the fourth depth, the fifth depth, the sixth depth, the seventh depth, and the eighth depth are equal, wherein the first-circular-thru-hole distance, the second-circular-thru-hole distance, the third-circular-thru-hole distance, and the fourth-circular-thru-hole distance are equal, and wherein the first-circular-thru-hole diameter, the second-circular-thru-hole diameter, the third-circular-thru-hole diameter, and the fourth-circular-thru-hole diameter are equal.

In another aspect, a method of assembling a toy is disclosed wherein the method comprises providing a flexible joint element, comprising a cylindrical flexible string having a flexible-string diameter, a first flexible-string-end and a second flexible-string-end, a first spherical component having a first-spherical-component diameter, a first-spherical-component center, and a first-spherical-component thru-hole through the first-spherical-component center, and a second spherical component having a second-spherical-component diameter, a second-spherical-component center, and a second-spherical-component thru-hole through the second-spherical-component center, wherein the first spherical component receives the flexible string through the first-spherical-component thru-hole and the first spherical component is coupled with the flexible string at the first flexible-string-end and wherein the second spherical component receives the flexible string through the second-spherical-component thru-hole and the second spherical component is coupled with the flexible string at the second flexible-string-end, thereby defining a flexible-joint-element length extending between the first-spherical-component center and the second-spherical-component center, and providing a first cuboid construction member, defined in a first three dimensional orthogonal coordinate system having orthogonal x axis, y axis, and z axis, said first cuboid construction member having a first face and a second face a first-member length apart along the x axis, a third face and a fourth face a first-member width apart along the y axis, and a fifth face and a sixth face a first-member height apart along the z axis, wherein the origin of the first three dimensional orthogonal coordinate system is at the first face center, said first cuboid construction member comprises a first rectangular blind slot, through the first face and across the first-member width toward the positive x direction having a first depth along the x axis and a first width along the z axis, a second rectangular blind slot, through the first face and across the first-member height toward the positive x direction having a second depth along the x axis and a second width along the y axis, a third rectangular blind slot, through the second face and across the first-member width toward the negative x direction having a third depth along the x axis and a third width along the z axis, a fourth rectangular blind slot, through the second face and across the first-member height toward the negative x direction having a fourth depth along the x axis and a fourth width along the y axis, a first circular thru-hole, through the fifth face and the sixth face, along the z axis having a first-circular-thru-hole center at a first-circular-thru-hole distance from an edge of the first face and a first-circular-thru-hole diameter, and a second circular thru-hole, through the fifth face and the sixth face, along the z axis having a second-circular-thru-hole center at a second-circular-thru-hole distance from an edge of the second face and a second-circular-thru-hole diameter, wherein the first cuboid construction member receives one of the first spherical component and the second spherical component of the flexible joint element via one of the first circular thru-hole and the second circular thru-hole of the first cuboid construction member.

Preferably, the first cuboid construction member further comprises a third circular thru-hole, through the third face and the fourth face, along the y axis having a third-circular-thru-hole center at a third-circular-thru-hole distance from the edge of the first face and a third-circular-thru-hole diameter, and a fourth circular thru-hole, through the third face and the fourth face, along the y axis having a fourth-circular-thru-hole center at a fourth-circular-thru-hole distance from the edge of the second face and a fourth-circular-thru-hole diameter, wherein the first cuboid construction member receives one of the first spherical component and the second spherical component of the flexible joint element via one of the first circular thru-hole, the second circular thru-hole, the third circular thru-hole, and the fourth circular thru-hole of the first cuboid construction member.

Preferably, the method further comprises providing a second cuboid construction member, defined in a second three dimensional orthogonal coordinate system having orthogonal u axis, v axis, and w axis, said second cuboid construction member having a seventh face and a eighth face a second-member length apart along the u axis, a ninth face and a tenth face a second-member width apart along the v axis, and a eleventh face and a twelfth face a second-member height apart along the w axis, wherein the origin of the second three dimensional orthogonal coordinate system is at the seventh face center, said second cuboid construction member comprises a fifth rectangular blind slot, through the seventh face and across the second-member width toward the positive u direction having a fifth depth along the u axis and a fifth width along the w axis, a sixth rectangular blind slot, through the seventh face and across the second-member height toward the positive u direction having a sixth depth along the u axis and a sixth width along the v axis, a seventh rectangular blind slot, through the eighth face and across the second-member width toward the negative u direction having a seventh depth along the u axis and a seventh width along the w axis, an eighth rectangular blind slot, through the eighth face and across the second-member height toward the negative u direction having an eighth depth along the u axis and an eighth width along the v axis, a third circular thru-hole, through the eleventh face and the twelfth face, along the w axis having a third-circular-thru-hole center at a third-circular-thru-hole distance from an edge of the seventh face and a third-circular-thru-hole diameter, and a fourth circular thru-hole, through the eleventh face and the twelfth face, along the w axis having a fourth-circular-thru-hole center at a fourth-circular-thru-hole distance from an edge of the eighth face and a fourth-circular-thru-hole diameter, wherein the second cuboid construction member receives the other one of the first spherical component and the second spherical component of the flexible joint element via one of the third circular thru-hole and the fourth circular thru-hole of the second cuboid construction member.

In another aspect, a toy assembly is disclosed wherein the assembly comprises a flexible joint element, comprising a cylindrical flexible string having a flexible-string diameter, a first flexible-string-end and a second flexible-string-end, a first spherical component having a first-spherical-component diameter, a first-spherical-component center, and a first-spherical-component thru-hole through the first-spherical-component center, and a second spherical component having a second-spherical-component diameter, a second-spherical-component center, and a second-spherical-component thru-hole through the second-spherical-component center, wherein the first spherical component receives the flexible string through the first-spherical-component thru-hole and the first spherical component is coupled with the flexible string at the first flexible-string-end and wherein the second spherical component receives the flexible string through the second-spherical-component thru-hole and the second spherical component is coupled with the flexible string at the second flexible-string-end, thereby defining a flexible-joint-element length extending between the first-spherical-component center and the second-spherical-component center, and a first cylindrical construction member, defined in a first three dimensional orthogonal coordinate system having orthogonal x axis, y axis, and z axis, said first cylindrical construction member having a first circular end and a second circular end a first-member length apart along the x axis, wherein a first-diameter of the first circular end is equal to a second-diameter of the second circular end, and a cylindrical surface confined between the first circular end and the second circular end, said cylindrical surface having a first-member diameter, wherein the origin of the first three dimensional orthogonal coordinate system is at the first circular end center, said first cylindrical construction member comprises a first rectangular blind slot, through the first circular end and across the first-member diameter toward the positive x direction having a first depth along the x axis and a first width along the z axis, a second rectangular blind slot, through the first circular end and across the first-member diameter toward the positive x direction having a second depth along the x axis and a second width along the y axis, a third rectangular blind slot, through the second circular end and across the first-member diameter toward the negative x direction having a third depth along the x axis and a third width along the z axis, a fourth rectangular blind slot, through the second circular end and across the first-member diameter toward the negative x direction having a fourth depth along the x axis and a fourth width along the y axis, a first circular thru-hole, through the cylindrical surface, along the z axis having a first-circular-thru-hole center at a first-circular-thru-hole distance from an edge of the first circular end and a first-circular-thru-hole diameter, and a second circular thru-hole, through the cylindrical surface, along the z axis having a second-circular-thru-hole center at a second-circular-thru-hole distance from an edge of the second circular end and a second-circular-thru-hole diameter, wherein the first cylindrical construction member receives one of the first spherical component and the second spherical component of the flexible joint element via one of the first circular thru-hole and the second circular thru-hole of the first cylindrical construction member.

DETAILED DESCRIPTION OF THE PRESENTLY PREFERRED EMBODIMENTS

Figure 1:
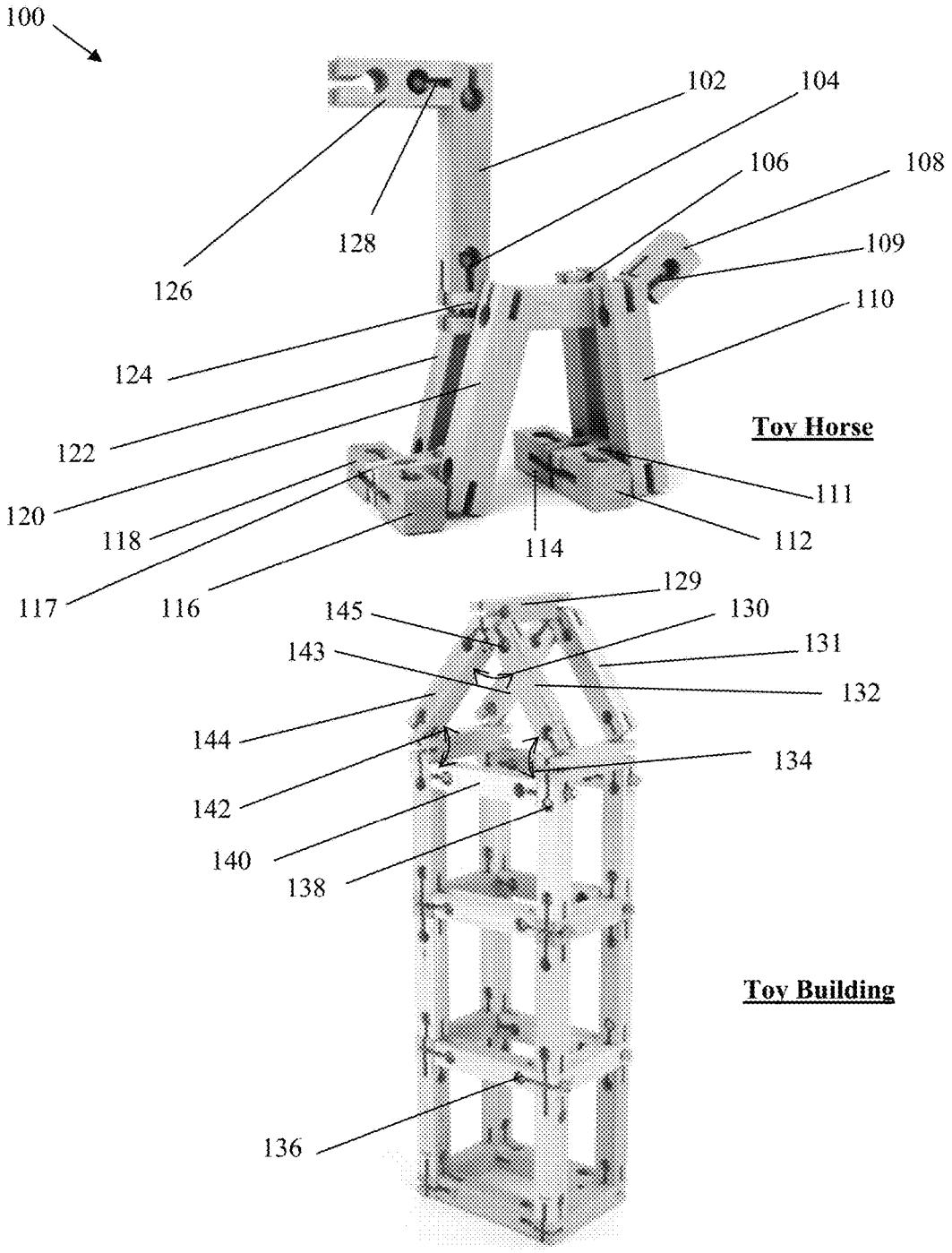
FIG. 1 shows a toy horse and a toy building constructed with plurality of a preferred embodiment of a toy assembly according to the present invention.

FIG. 1 depicts a diagram 100 of a toy horse and a toy building constructed with plurality of a preferred embodiment of a toy assembly according to the present invention. The toy horse includes a head represented by a cuboid construction member 126. The neck of the toy horse is represented by a cuboid construction member 102 which is coupled to the head via a flexible joint element 128. The torso of the toy horse is represented by a cuboid construction member 124 coupled to the neck of the horse via flexible joint element 104. The toy horse includes four (4) legs represented by four (4) cuboid construction members 106, 110, 120, and 122 which are coupled to the torso 124 via flexible joint elements (not seen in this figure) similar to the flexible joint element 128. The toy horse includes four (4) paws represented by four (4) cuboid construction members 112, 114, 116, and 118 which are coupled to the four (4) legs 106, 110, 120, 122, via two cuboid construction members 111 and 117 and several other flexible joint elements (not seen in this figure). Finally, the horse includes a tail represented by a cuboid construction member 108 which is coupled to the torso 124 via a flexible joint element 109.

FIG. 1 also shows a toy building constructed from plurality of flexible joint elements and cuboid construction members. The roof of the toy building is represented by five (5) cuboid construction members 129, 131, 132, 143, and 144 which are coupled together via several flexible joint elements such a flexible joint element 145. The body of the toy building is represented by several cuboid construction members, such as a cuboid construction member 140, and several flexible joint elements, such flexible joint elements 136 and 138. The roof of the toy building has a triangular shape with angles 130, 134, and 142 between the cuboid construction members 140 and 144, 144 and 132, and 132 and 140. It should be clear to artisans of ordinary skill that the angles 130, 134, and 142 can be changed by simply utilizing different cuboid construction members of different lengths, discussed in more detail below.

Figure 2:
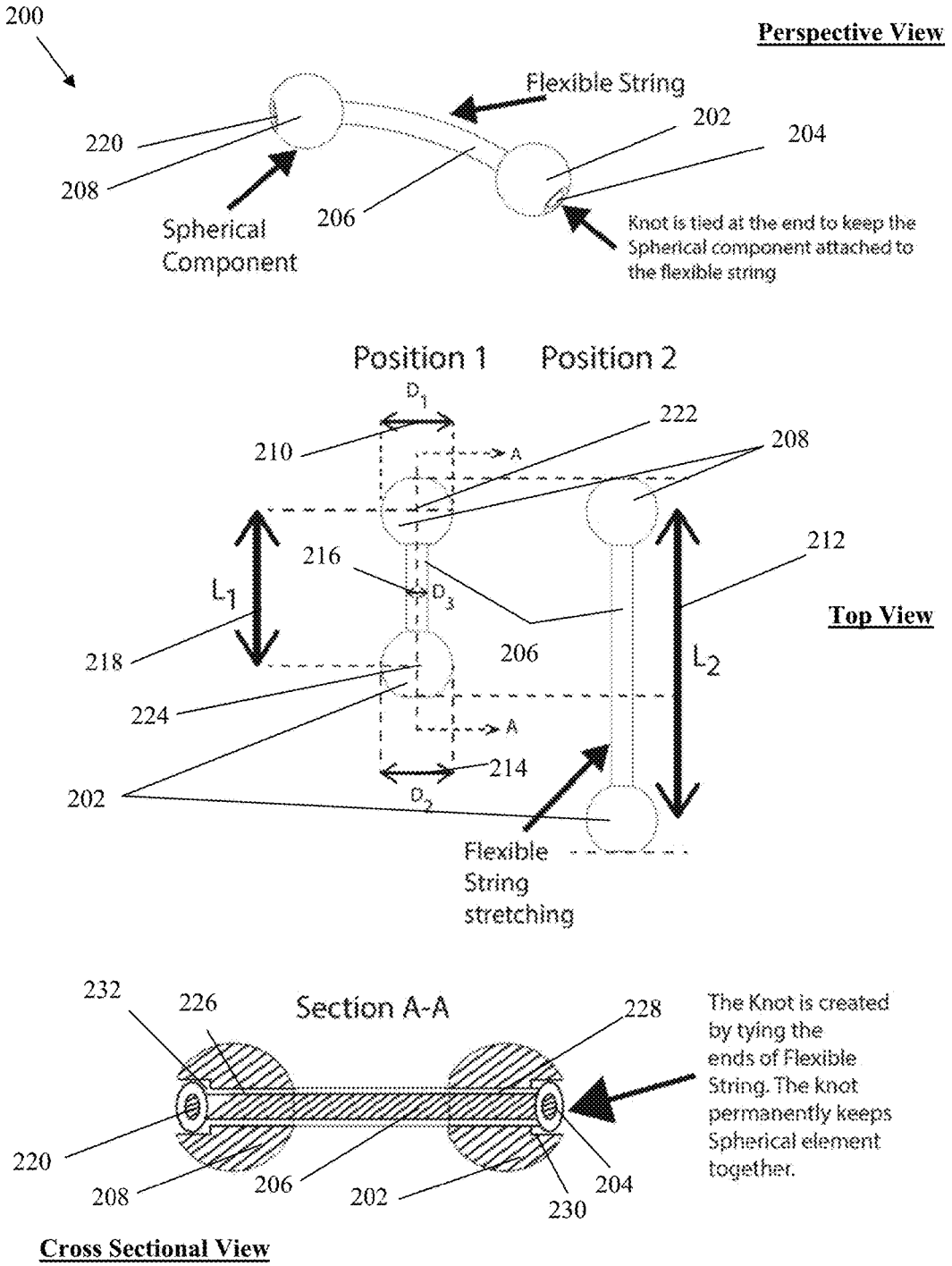
FIG. 2 shows a perspective view, a top view, and a cross sectional view of a preferred embodiment of a flexible joint element of a toy assembly according to the present invention.

FIG. 2 depicts a perspective view, a top view, and a cross sectional view of a preferred embodiment of a flexible joint element 200 of a toy assembly according to the present invention. The flexible joint element 200 comprises a cylindrical flexible string 206 having a flexible-string diameter $D_3$ at 216, a first flexible-string-end 220 and a second flexible-string-end 204. The flexible joint element 200 further comprises a first spherical component 208 having a first-spherical-component diameter $D_1$ at 210, a first-spherical-component center 222, and a first-spherical-component thru-hole 226 through the first-spherical-component center 222. The flexible joint element 200 further comprises a second spherical component 202 having a second-spherical-component diameter $D_2$ at 214, a second-spherical-component center 224, and a second-spherical-component thru-hole 228 through the second-spherical-component center 224.

The first spherical component 208 receives the flexible string 206 through the first-spherical-component thru-hole 226 and the first spherical component 208 is coupled with the flexible string 206 at the first flexible-string-end 220. The second spherical component 202 receives the flexible string 206 through the second-spherical-component thru-hole 228 and the second spherical component 202 is coupled with the flexible string 206 at the second flexible-string-end 204. As such, the first spherical component 208, the second spherical component 202, and the flexible string 206 define a flexible-joint-element length $L_1$ at 218 extending between the first-spherical-component center 222 and the second-spherical-component center 224. In this preferred embodiment, the first flexible-string-end 220 and the second flexible-string-end 204 comprise knots which are tied after the flexible string 206 is inserted into the first spherical component 208 and second spherical component 202 so as to keep the first spherical component 208 and the second spherical component 202 attached to the flexible string 206. Two recessed holes 230 and 232 are provided to accommodate the two knots.

In a preferred embodiment, the first spherical component 208 and the second spherical component 202 are made from polyethylene, otherwise known to artisans of ordinary skill as plastic. In particular, the material is hard plastic, such as high-density polyethylene (HDPE) having an extremely smooth surface finish so as to provide easy movements within the circular holes of construction members, discussed in more detail below.

In a preferred embodiment, the cylindrical flexible string 206 is made from an elastomeric material, such as rubber, which provides for the flexibility of the flexible joint element 200. FIG. 2 shows the top view of the flexible joint element 200 in its neutral and elongated states having lengths $L_1$ at 218 and $L_2$ at 212, respectively. The first spherical component 208 and the second spherical component 202 are inserted in circular holes of two construction members. As discussed in more detail below in connection with the geometry and features of construction members, their width, height, slots, and circular holes are of such dimensions which provide for the flexible joint element 200 to acquire its elongated state thereby creating tension in the flexible joint element 200 which holds the two construction members together.

Figure 3:
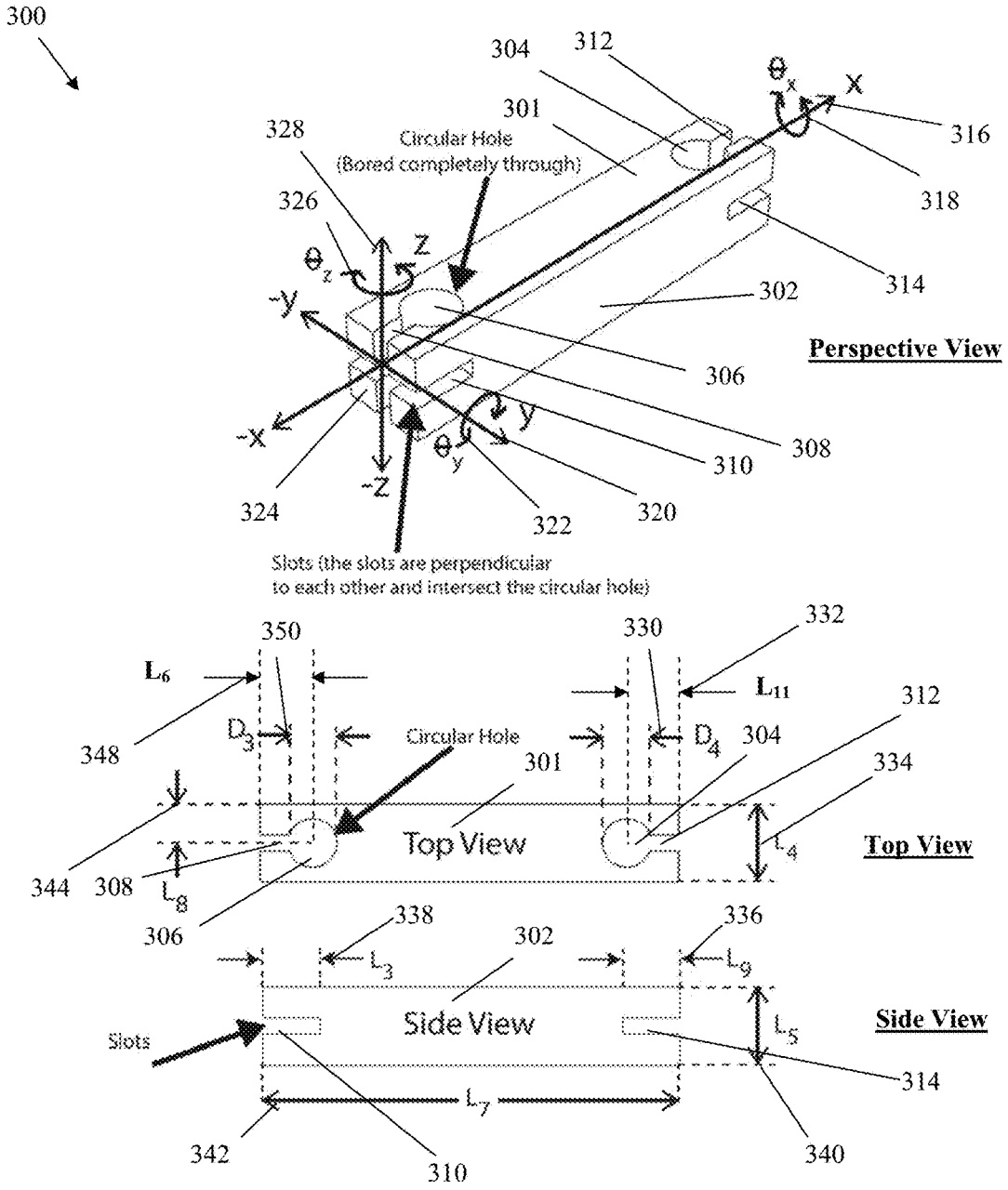
FIG. 3 shows a perspective view, a top view, and a side view of a preferred embodiment of a cuboid construction member of a toy assembly according to the present invention.

FIG. 3 depicts a perspective view, a top view, and a side view of a preferred embodiment of a cuboid construction member 300 of a toy assembly according to the present invention. For clarity, the cuboid construction member 300 is defined in a three dimensional orthogonal coordinate system having orthogonal x axis 316, y axis 320, and z axis 328. The angles $\theta_x$, $\theta_y$, and $\theta_z$ at 318, 322, and 326, respectively, correspond to angles of rotations of the cuboid construction member 300 along the orthogonal x axis 316, y axis 320, and z axis 328. Having so defined the coordinate systems, the features of the cuboid construction member 300 are now described.

The cuboid construction member 300 has a first face 324 and a second face (on the opposite side which is not visible)

a member length $L_7$ at 342 apart along the x axis 316, a third face 302 and a fourth face (on the opposite side which is not visible) a member width $L_4$ at 334 apart along the y axis 320, and a fifth face 301 and a sixth face (on the opposite side which is not visible) a member height $L_5$ at 340 apart along the z axis 328 wherein the origin of the three dimensional orthogonal coordinate system (x,y,z) is at center of the first face 324.

Figure 4:
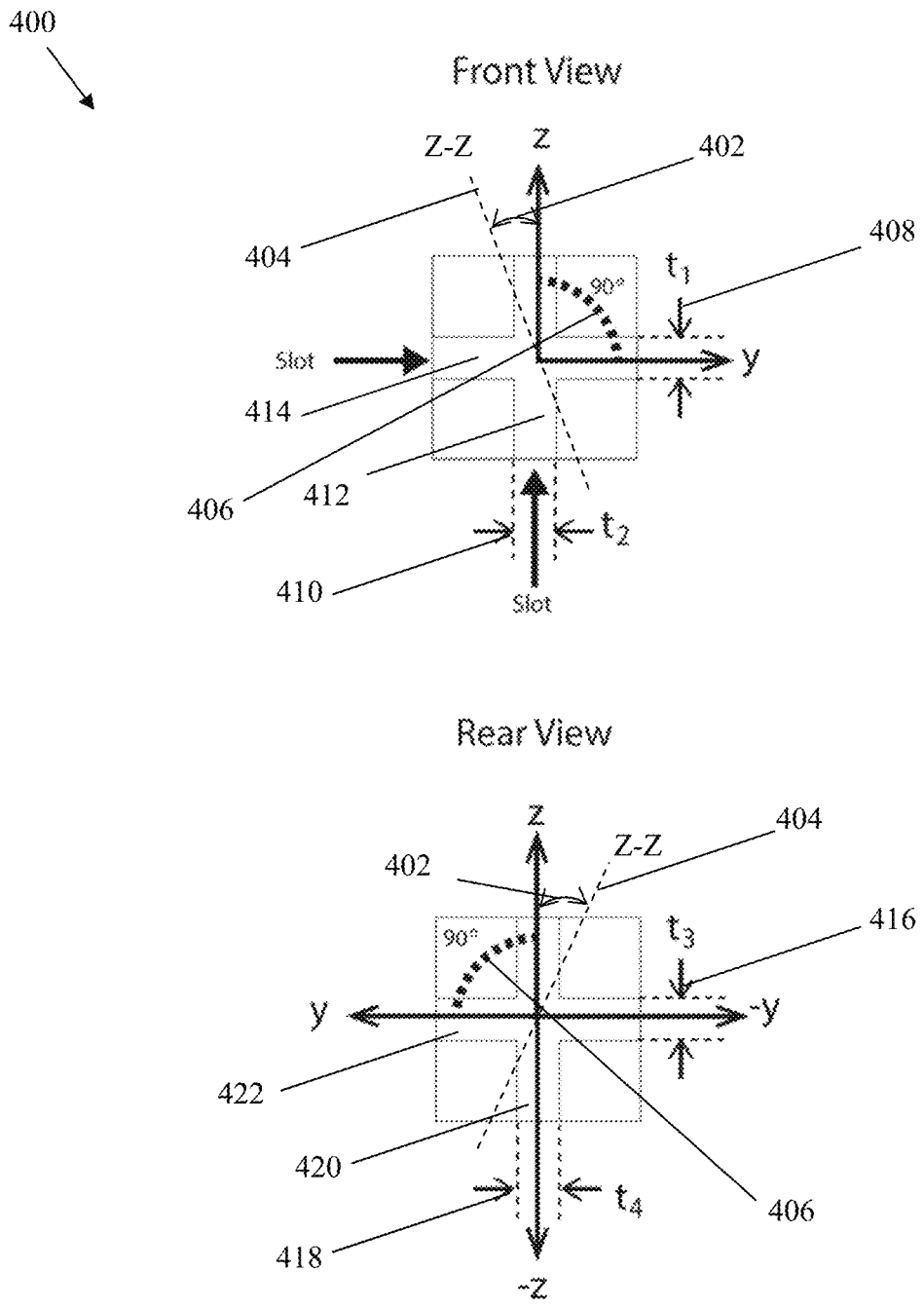
FIG. 4 shows a front view and a rear view of a preferred embodiment of a cuboid construction member of a toy assembly according to the present invention.

The cuboid construction member 300 has four (4) rectangular blind slots and two (2) circular thru-holes which are now described further utilizing, in a non-limiting manner, FIG. 4 for clarity. A first rectangular blind slot 310 through the first face 324 and across the member width $L_4$ at 334 toward the positive x direction has a first depth $L_3$ at 338 along the x axis 316 and a first width $t_1$ at 408 (see FIG. 4) along the z axis 328. A second rectangular blind slot 308 through the first face 324 and across the member height $L_5$ at 340 toward the positive x direction has a second depth $L_6$ at 348 along the x axis 316 and a second width $t_2$ at 410 (see FIG. 4) along the y axis 320. A third rectangular blind slot 314 through the second face and across the member width $L_4$ at 334 toward the negative x (−x) direction has a third depth $L_9$ at 336 along the x axis 316 and a third width $t_3$ at 416 (see FIG. 4) along the z axis 328. A fourth rectangular blind slot 312 through the second face and across the member height $L_5$ at 340 toward the negative x (−x) direction has a fourth depth $L_{11}$ at 332 along the x axis and a fourth width $t_4$ at 418 (see FIG. 4) along the y axis 320. A first circular thru-hole 306 through the fifth face 301 and the sixth face along the z axis 328 has a first-circular-thru-hole center at a first-circular-thru-hole distance, in this preferred embodiment equal to $L_6$ at 348, from an edge of the first face 324 and a first-circular-thru-hole diameter $D_3$ at 350. A second circular thru-hole 304 through the fifth face 301 and the sixth face along the z axis 328 has a second-circular-thru-hole center at a second-circular-thru-hole distance, in this preferred embodiment equal to $L_{11}$ at 332, from an edge of the second face and a second-circular-thru-hole diameter $D_4$ at 330.

The four (4) rectangular blind slots 310, 308, 314, 312, and the two (2) circular thru-holes 306 and 304, as described above, are utilized to receive the flexible joint element 200 together making the toy assembly of the present invention. Specifically, the cuboid construction member 300 receives the first spherical component 208 or the second spherical component 202 of the flexible joint element 200 via either the first circular thru-hole 306 or the second circular thru-hole 304. A plurality of the toy assembly can be assembled to render many different shapes and configurations such as the toy horse and toy building shown in FIG. 1. Furthermore, different machining techniques, known to artisans of ordinary skill, can be utilized to machine the four (4) rectangular blind slots 310, 308, 314, 312, and the two (2) circular thru-holes 306 and 304 into the cuboid construction member 300. In a preferred embodiment, the cuboid construction member 300 is made from wood but other materials such as ceramics, metals, plastics, and glass can be used.

In a preferred embodiment, the first-spherical-component diameter $D_1$ at 210 is equal to the second-spherical-component diameter $D_2$ at 214. According to one instance $D_1$ is equal to $D_2$ is equal to 10 millimeter. In a preferred embodiment, the flexible string 206 has the flexible-string diameter $D_3$ at 216 equal to 1 millimeter. In a preferred embodiment, the lengths $L_1$ at 218 is equal to 9 millimeter and $L_2$ at 212 is equal to 24 millimeter.

FIG. 4 depicts a front view and a rear view of a preferred embodiment of a cuboid construction member 400 of a toy assembly according to the present invention. Rectangular slots 414 and 412 are shown on a first face of cuboid construction member 400, and rectangular slots 422 and 420 are shown on a second face of the cuboid construction member 400. FIG. 4 is also used to clarify the four (4) rectangular slots of the cuboid construction member 300.

The slot thicknesses $t_1$ at 408, $t_2$ at 410, $t_3$ at 416, and $t_4$ at 418 are as shown with respect to the y-z coordinate axes and are at right angles to each other. Specifically, the slot 414 is at 90 degrees to the slot 412, and the slot 422 is at 90 degrees to the slot 420. However, in a different preferred embodiment, the slot 412 can be machined into the cuboid construction member 400 along the Z-Z axis at 404 at an arbitrary angle at 402, for instance 15 degrees, from the z axis.

In a preferred embodiment, the slot thicknesses $t_1$ at 408, $t_2$ at 410, $t_3$ at 416, and $t_4$ at 418 are all equal to 4 millimeter. In a preferred embodiment, the first depth $L_3$ at 338 is equal to the second depth $L_6$ at 348 is equal to the third depth $L_9$ at 336 is equal to the fourth depth $L_{11}$ at 332 which is equal to 14 millimeter. In a preferred embodiment, the first-circular-thru-hole distance is equal to $L_6$ at 348 and the second-circular-thru-hole distance is equal to $L_{11}$ at 332 which is equal to 14 millimeter. In a preferred embodiment the first-circular-thru-hole diameter $D_3$ at 350 is equal to the second-circular-thru-hole diameter $D_4$ at 330 which is equal to 11 millimeter. In a preferred embodiment, the first face 324 and second face are square surfaces and thus the member width $L_4$ at 334 and member height $L_5$ at 340 are equal which is equal to 19 millimeter. In a preferred embodiment, the member length $L_7$ at 342 is equal to 100 millimeter.

Figure 5:
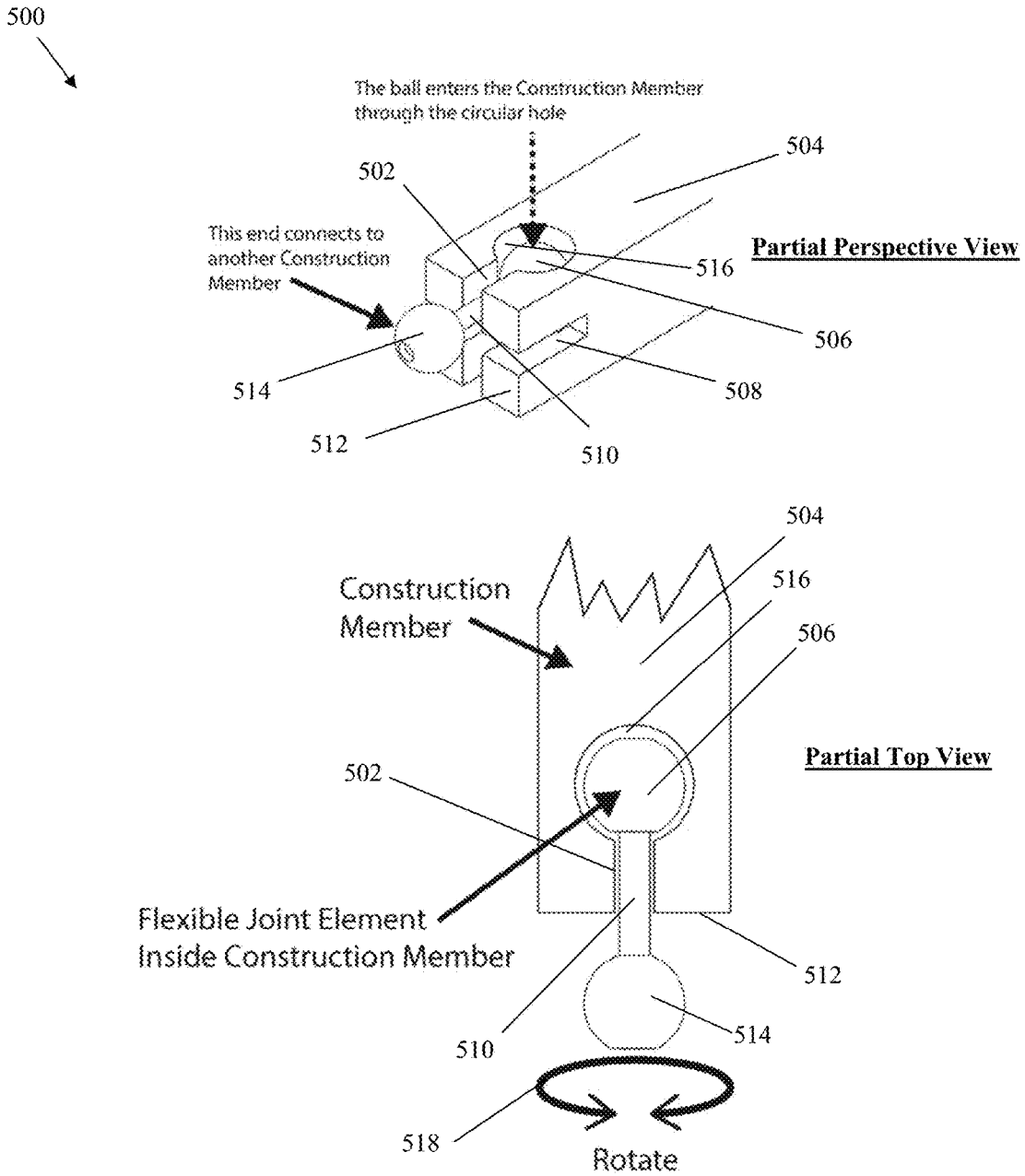
FIG. 5 shows a partial perspective view and a partial top view of a preferred embodiment of a toy assembly according to the present invention.

FIG. 5 depicts a partial perspective view and a partial top view of a preferred embodiment of a toy assembly 500 according to the present invention. The toy assembly 500 comprises a flexible joint element including of a cylindrical flexible string 510, a first spherical component 506, and a second spherical component 514. The toy assembly 500 further comprises a cuboid construction member 504 which includes a first face 512 and two rectangular blind slots 508 and 502 through the first face 512. The cuboid construction member 504 further comprises a circular thru-hole 516 through its fifth face.

In practice, the flexible joint element is coupled with the cuboid construction member 504 through its aperture, i.e., the two rectangular blind slots 508 and 502 and circular through-hole 516. Specifically, the first spherical component 506 is inserted into the circular thru-hole 516 and the cylindrical flexible string 510 goes through the slot 502 providing for the second spherical component 514 to be exposed and operative to engage another cuboid construction member. The flexible joint element can be rotated in all 3 directions, such as the angles $\theta_x$, $\theta_y$, and $\theta_z$ at 318, 322, and 326, described above in connection with the cuboid construction member 300. As such, the other cuboid construction member can be placed in various different angles with respect to the cuboid construction member 504. The partial top view in FIG. 5 clearly shows how easily the flexible joint element can be inserted into the construction member.

Figure 6:
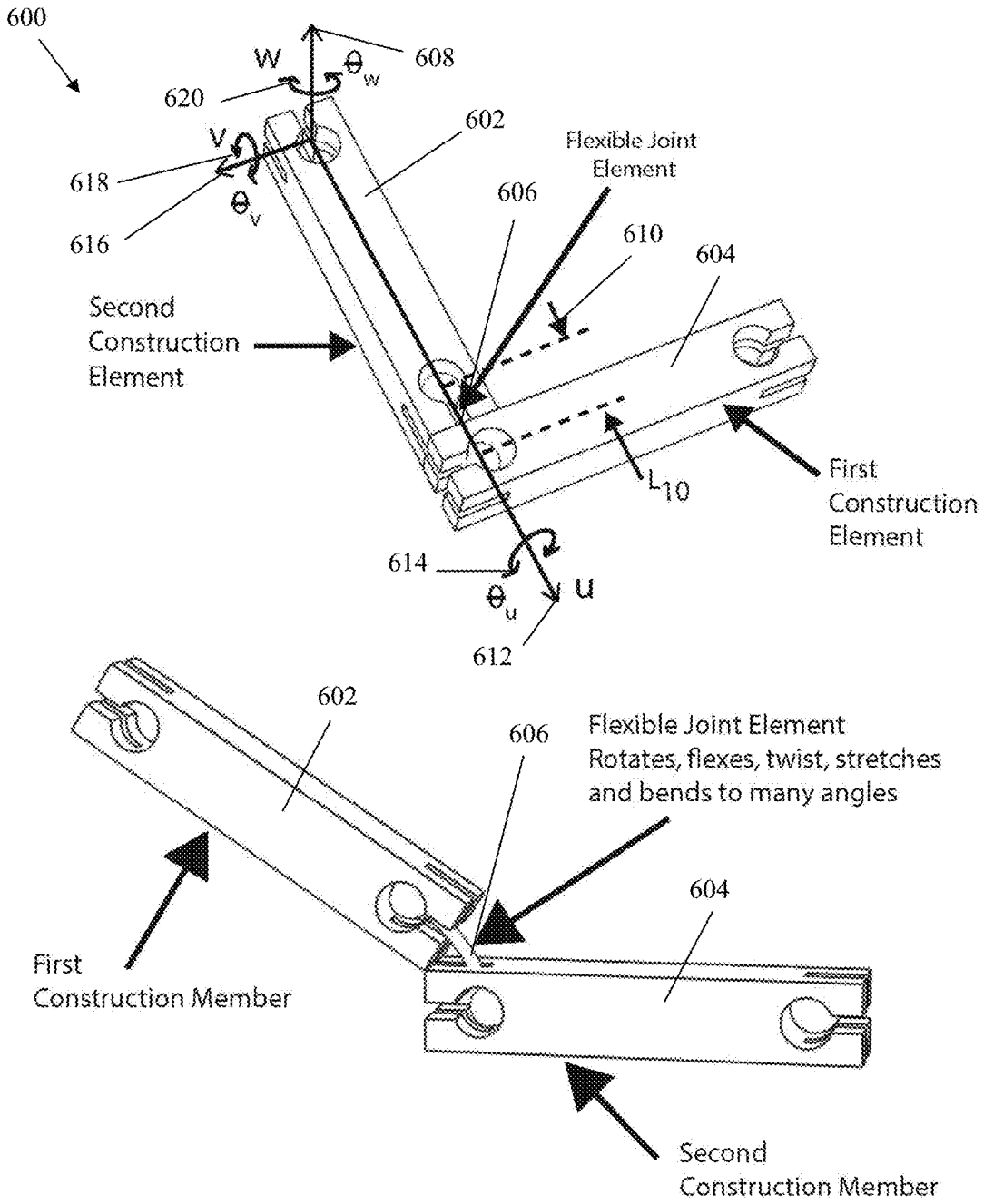
FIG. 6 shows perspective views of a preferred embodiment of a toy assembly having two cuboid construction members coupled together via a flexible joint element according to the present invention.

FIG. 6 depicts two perspective views of a preferred embodiment of a toy assembly 600 having two cuboid construction members coupled together via a flexible joint element in two different configurations according to the present invention. A first cuboid construction member 604 is coupled with a second cuboid construction member 602 via a flexible joint element 606. For clarity, the geometry of the second cuboid construction member 602 is defined in a second three dimensional orthogonal coordinate system having orthogonal u axis at 612, v axis at 616, and w axis at 608. The angles $\theta_u$, $\theta_v$, and $\theta_w$ at 614, 618, and 620, respectively, correspond to angles of rotations of the second cuboid construction member 602 along the orthogonal u axis at 612, v axis at 616, and w axis at 608. Having so defined the coordinate systems, the features of the second cuboid construction member 602 can be readily defined with respect to the second three dimensional coordinate system.

In FIG. 6 it can be seen that the second cuboid construction member 602 is coupled with the first cuboid construction member 604 via the flexible joint element 606. In particular, the distance $L_{10}$ at 610 between the centers of the circular-thru-holes of the first cuboid construction member 604 and the second cuboid construction member 602 is greater than the neutral length of the flexible joint element 606. As such, the flexible joint element 606 is in its elongated state which creates a holding force between the second face of the second cuboid construction member 602 and the fourth face of the first cuboid construction member 604. Accordingly, a plurality of cuboid construction members and flexible joint elements can be coupled with similar holding forces allowing one to construct assemblies such as the toy horse and toy building shown in FIG. 1. It can also be seen that the second cuboid construction member 602 can rotate around the u, v, and w axes at any desired angle $\theta_u$, $\theta_v$, and $\theta_w$ providing for coupling of cuboid construction members at various angles. Lastly, construction members are not limited to cuboid geometry. In a preferred embodiment, the construction member is cylindrical having four (4) rectangular blind slots through its first circular end and second circular end, and two (2) thru-holes through its cylindrical surface confined between the first circular end and the second circular end.

The foregoing explanations, descriptions, illustrations, examples, and discussions have been set forth to assist the reader with understanding this invention and further to demonstrate the utility and novelty of it and are by no means restrictive of the scope of the invention. It is the following claims, including all equivalents, which are intended to define the scope of this invention.

What is claimed is:

1. A toy assembly, comprising:

(a) a flexible joint element, comprising:

(i) a cylindrical flexible string, having a rubber core, said flexible string having a flexible-string diameter, a first flexible-string-end and a second flexible-string-end;

(ii) a first spherical component having a first-spherical-component diameter, a first-spherical-component center, and a first-spherical-component thru-hole through the first-spherical-component center; and (iii) a second spherical component having a second-spherical-component diameter, a second-spherical-component center, and a second-spherical-component thru-hole through the second-spherical-component center;

wherein the first spherical component receives the flexible string through the first-spherical-component thru-hole and the first spherical component is coupled with the flexible string at the first flexible-string-end and wherein the second spherical component receives the flexible string through the second-spherical-component thru-hole and the second spherical component is coupled with the flexible string at the second flexible-string-end, thereby defining a flexible-joint-element length extending between the first-spherical-component center and the second-spherical-component center; and (b) a first readily removable and replaceable elemental cuboid construction member of arbitrary shape, defined in a first three dimensional orthogonal coordinate system having orthogonal x axis, y axis, and z axis, said first readily removable and replaceable elemental cuboid construction member of arbitrary shape having a first face and a second face a first-member length apart along the x axis, a third face and a fourth face a first-member width apart along the y axis, and a fifth face and a sixth face a first-member height apart along the z axis, wherein the origin of the first three dimensional orthogonal coordinate system is at the first face center, said first readily removable and replaceable elemental cuboid construction member of arbitrary shape comprises:

(i) a first rectangular blind slot, through the first face and across the first-member width toward the positive x direction having a first depth along the x axis and a first width along the z axis;

(ii) a second rectangular blind slot, through the first face and across the first-member height toward the positive x direction having a second depth along the x axis and a second width along the y axis;

(iii) a third rectangular blind slot, through the second face and across the first-member width toward the negative x direction having a third depth along the x axis and a third width along the z axis;

(iv) a fourth rectangular blind slot, through the second face and across the first-member height toward the negative x direction having a fourth depth along the x axis and a fourth width along the y axis;

(v) a first circular thru-hole, through the fifth face and the sixth face, along the z axis having a first-circular-thru-hole center at a first-circular-thru-hole distance from an edge of the first face and a first-circular-thru-hole diameter; and (vi) a second circular thru-hole, through the fifth face and the sixth face, along the z axis having a second-circular-thin-hole center at a second-circular-thru-hole distance from an edge of the second face and a second-circular-thru-hole diameter;

wherein the first readily removable and replaceable elemental cuboid construction member of arbitrary shapes receives one of the first spherical component and the second spherical component of the flexible joint element via one of the first circular thru-hole and the second circular thru-hole of the first readily removable and replaceable elemental cuboid construction member of arbitrary shape.

2. The toy assembly of claim 1, wherein the first-spherical-component diameter is equal to the second-spherical-component diameter.

3. The toy assembly of claim 1, wherein the first-spherical-component thru-hole is circular having a first-spherical-component-thru-hole diameter, wherein the second-spherical-component thru-hole is circular having a second-spherical-component-thru-hole diameter, wherein the first-spherical-component-thru-hole diameter is equal to the second-spherical-component-thru-hole diameter, and wherein the flexible-string diameter is less than or equal to the first-spherical-component-thru-hole diameter.

4. The toy assembly of claim 1, wherein the first spherical component is coupled with the flexible string at the first flexible-string-end by tying a first knot at the first flexible-string-end and the second spherical component is coupled with the flexible string at the second flexible-string-end by tying a second knot at the second flexible-string-end.

5. The toy assembly of claim 1, wherein the second rectangular blind slot, through the first face, is along a z-z axis, said z-z-axis is at a first angle from the z axis.

6. The toy assembly of claim 1, wherein the first-member width is equal to the first-member height.

7. The toy assembly of claim 1, wherein the first width is equal to the second width.

8. The toy assembly of claim 1, wherein the first depth is equal to the second depth.

9. The toy assembly of claim 1, wherein the first-circular-thru-hole distance is equal to the second-circular-thru-hole distance.

10. The toy assembly of claim 1, wherein the first-circular-thru-hole diameter is equal to the second-circular-thru-hole diameter.

11. The toy assembly of claim 1, wherein the first width, the second width, the third width, and the fourth width are equal, wherein the first depth, the second depth, the third depth, and the fourth depth are equal, wherein the first-circular-thru-hole distance and the second-circular-thru-hole distance are equal, and wherein the first-circular-thru-hole diameter and the second-circular-thru-hole diameter are equal.

12. The toy assembly of claim 1, wherein the first readily removable and replaceable elemental cuboid construction member of arbitrary shape further comprises:

(vii) a third circular thru-hole, through the third face and the fourth face, along the y axis having a third-circular-thru-hole center at a third-circular-thru-hole distance from the edge of the first face and a third-circular-thru-hole diameter; and (viii) a fourth circular thru-hole, through the third face and the fourth face, along the y axis having a fourth-circular-thru-hole center at a fourth-circular-thru-hole distance from the edge of the second face and a fourth-circular-thru-hole diameter;

wherein the first readily removable and replaceable elemental cuboid construction member of arbitrary shape receives one of the first spherical component and the second spherical component of the flexible joint element via one of the first circular thru-hole, the second circular thru-hole, the third circular thru-hole, and the fourth circular thru-hole of the first readily removable and replaceable elemental cuboid construction member of arbitrary shape.

13. The toy assembly of claim 1, further comprising:

(c) a second readily removable and replaceable elemental cuboid construction member of arbitrary shape, defined in a second three dimensional orthogonal coordinate system having orthogonal u axis, v axis, and w axis, said second readily removable and replaceable elemental cuboid construction member of arbitrary shape having a seventh face and a eighth face a second-member length apart along the u axis, a ninth face and a tenth face a second-member width apart along the v axis, and a eleventh face and a twelfth face a second-member height apart along the w axis, wherein the origin of the second three dimensional orthogonal coordinate system is at the seventh face center, said second readily removable and replaceable elemental cuboid construction member of arbitrary shape comprises:

(i) a fifth rectangular blind slot, through the seventh face and across the second-member width toward the positive u direction having a fifth depth along the u axis and a fifth width along the w axis;

(ii) a sixth rectangular blind slot, through the seventh face and across the second-member height toward the positive u direction having a sixth depth along the u axis and a sixth width along the v axis;

(iii) a seventh rectangular blind slot, through the eighth face and across the second-member width toward the negative u direction having a seventh depth along the u axis and a seventh width along the w axis;

(iv) an eighth rectangular blind slot, through the eighth face and across the second-member height toward the negative u direction having an eighth depth along the u axis and an eighth width along the v axis;

(v) a third circular thru-hole, through the eleventh face and the twelfth face, along the w axis having a third-circular-thru-hole center at a third-circular-thru-hole distance from an edge of the seventh face and a third-circular-thru-hole diameter; and (vi) a fourth circular thru-hole, through the eleventh face and the twelfth face, along the w axis having a fourth-circular-thru-hole center at a fourth-circular-thru-hole distance from an edge of the eighth face and a fourth-circular-thru-hole diameter;

wherein the second readily removable and replaceable elemental cuboid construction member of arbitrary shape receives the other one of the first spherical component and the second spherical component of the flexible joint element via one of the third circular thru-hole and the fourth circular thru-hole of the second readily removable and replaceable elemental cuboid construction member of arbitrary shape.

14. The toy assembly of claim 13, wherein the second-member length is one of one half and one quarter of the first-member length.

15. The toy assembly of claim 13, wherein the first-member width, the first-member height, the second-member width, and the second-member height are equal.

16. The toy assembly of claim 13, wherein the first width, the second width, the third width, the fourth width, the fifth width, the sixth width, the seventh width, and the eighth width are equal, wherein the first depth, the second depth, the third depth, the fourth depth, the fifth depth, the sixth depth, the seventh depth, and the eighth depth are equal, wherein the first-circular-thru-hole distance, the second-circular-thru-hole distance, the third-circular-thru-hole distance, and the fourth-circular-thru-hole distance are equal, and wherein the first-circular-thru-hole diameter, the second-circular-thru-hole diameter, the third-circular-thru-hole diameter, and the fourth-circular-thru-hole diameter are equal.

17. A method of assembling a toy, comprising:

(a) providing a flexible joint element, comprising:

(i) a cylindrical flexible string, having a rubber core, said flexible string having a flexible-string diameter, a first flexible-string-end and a second flexible-string-end;

(ii) a first spherical component having a first-spherical-component diameter, a first-spherical-component center, and a first-spherical-component thru-hole through the first-spherical-component center; and (iii) a second spherical component having a second-spherical-component diameter, a second-spherical-component center, and a second-spherical-component thru-hole through the second-spherical-component center;

wherein the first spherical component receives the flexible string through the first-spherical-component thru-hole and the first spherical component is coupled with the flexible string at the first flexible-string-end and wherein the second spherical component receives the flexible string through the second-spherical-component thru-hole and the second spherical component is coupled with the flexible string at the second flexible-string-end, thereby defining a flexible-joint-element length extending between the first-spherical-component center and the second-spherical-component center; and (b) providing a first readily removable and replaceable elemental cuboid construction member of arbitrary shape, defined in a first three dimensional orthogonal coordinate system having orthogonal x axis, y axis, and z axis, said first readily removable and replaceable elemental cuboid construction member of arbitrary shape having a first face and a second face a first-member length apart along the x axis, a third face and a fourth face a first-member width apart along the y axis, and a fifth face and a sixth face a first-member height apart along the z axis, wherein the origin of the first three dimensional orthogonal coordinate system is at the first face center, said first readily removable and replaceable elemental cuboid construction member of arbitrary shape comprises:

(i) a first rectangular blind slot, through the first face and across the first-member width toward the positive x direction having a first depth along the x axis and a first width along the z axis;

(ii) a second rectangular blind slot, through the first face and across the first-member height toward the positive x direction having a second depth along the x axis and a second width along the y axis;

(iii) a third rectangular blind slot, through the second face and across the first-member width toward the negative x direction having a third depth along the x axis and a third width along the z axis;

(iv) a fourth rectangular blind slot, through the second face and across the first-member height toward the negative x direction having a fourth depth along the x axis and a fourth width along the y axis;

(v) a first circular thru-hole, through the fifth face and the sixth face, along the z axis having a first-circular-thru-hole center at a first-circular-thru-hole distance from an edge of the first face and a first-circular-thru-hole diameter; and (vi) a second circular thru-hole, through the fifth face and the sixth face, along the z axis having a second-circular-thru-hole center at a second-circular-thru-hole distance from an edge of the second face and a second-circular-thru-hole diameter;

wherein the first readily removable and replaceable elemental cuboid construction member of arbitrary shape receives one of the first spherical component and the second spherical component of the flexible joint element via one of the first circular thru-hole and the second circular thru-hole of the first readily removable and replaceable elemental cuboid construction member of arbitrary shape.

18. The method of claim 17, wherein the first readily removable and replaceable elemental cuboid construction member of arbitrary shape further comprises:

(vii) a third circular thru-hole, through the third face and the fourth face, along the y axis having a third-circular-thru-hole center at a third-circular-thru-hole distance from the edge of the first face and a third-circular-thru-hole diameter; and (viii) a fourth circular thru-hole, through the third face and the fourth face, along the y axis having a fourth-circular-thru-hole center at a fourth-circular-thru-hole distance from the edge of the second face and a fourth-circular-thru-hole diameter;

wherein the first readily removable and replaceable elemental cuboid construction member of arbitrary shape receives one of the first spherical component and the second spherical component of the flexible joint element via one of the first circular thru-hole, the second circular thru-hole, the third circular thru-hole, and the fourth circular thru-hole of the first readily removable and replaceable elemental cuboid construction member of arbitrary shape.

19. The method of claim 17, further comprising:

(c) providing a second readily removable and replaceable elemental cuboid construction member of arbitrary shape, defined in a second three dimensional orthogonal coordinate system having orthogonal u axis, v axis, and w axis, said second readily removable and replaceable elemental cuboid construction member of arbitrary shape having a seventh face and a eighth face a second-member length apart along the u axis, a ninth face and a tenth face a second-member width apart along the v axis, and a eleventh face and a twelfth face a second-member height apart along the w axis, wherein the origin of the second three dimensional orthogonal coordinate system is at the seventh face center, said second readily removable and replaceable elemental cuboid construction member of arbitrary shape comprises:

(i) a fifth rectangular blind slot, through the seventh face and across the second-member width toward the positive u direction having a fifth depth along the u axis and a fifth width along the w axis;

(ii) a sixth rectangular blind slot, through the seventh face and across the second-member height toward the positive u direction having a sixth depth along the u axis and a sixth width along the v axis;

(iii) a seventh rectangular blind slot, through the eighth face and across the second-member width toward the negative u direction having a seventh depth along the u axis and a seventh width along the w axis;

(iv) an eighth rectangular blind slot, through the eighth face and across the second-member height toward the negative u direction having an eighth depth along the u axis and an eighth width along the v axis;

(v) a third circular thru-hole, through the eleventh face and the twelfth face, along the w axis having a third-circular-thru-hole center at a third-circular-thru-hole distance from an edge of the seventh face and a third-circular-thru-hole diameter; and (vi) a fourth circular thru-hole, through the eleventh face and the twelfth face, along the w axis having a fourth-circular-thru-hole center at a fourth-circular-thru-hole distance from an edge of the eighth face and a fourth-circular-thru-hole diameter;

wherein the second readily removable and replaceable elemental cuboid construction member of arbitrary shape receives the other one of the first spherical component and the second spherical component of the flexible joint element via one of the third circular thru-hole and the fourth circular thru-hole of the second readily removable and replaceable elemental cuboid construction member of arbitrary shape.

* * * * *